US010991528B2

(12) United States Patent
Ranjan et al.

(10) Patent No.: US 10,991,528 B2
(45) Date of Patent: Apr. 27, 2021

(54) GAS-INSULATED LOAD BREAK SWITCH AND SWITCHGEAR COMPRISING A GAS-INSULATED LOAD BREAK SWITCH

(71) Applicant: ABB Schweiz AG, Baden (CH)

(72) Inventors: Nitesh Ranjan, Niederrohrdorf (CH); Elham Attar, Porsgrunn (NO); Jan Carstensen, Waldshut-Tiengen (DE); Magne Saxegaard, Porsgrunn (NO); Martin Kristoffersen, Porsgrunn (NO); Ståle Talmo, Skien (NO); Stanley Lohne, Porsgrunn (NO); Michael Schwinne, Ehrendingen (CH); Martin Seeger, Oberentfelden (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/626,199

(22) PCT Filed: Jun. 12, 2018

(86) PCT No.: PCT/EP2018/065480

§ 371 (c)(1),
(2) Date: Dec. 23, 2019

(87) PCT Pub. No.: WO2019/001946

PCT Pub. Date: Jan. 3, 2019

(65) Prior Publication Data

US 2020/0126742 A1 Apr. 23, 2020

(30) Foreign Application Priority Data

Jun. 29, 2017 (EP) ..... 17178561

(51) Int. Cl.
*H01H 33/12* (2006.01)
*H01H 33/22* (2006.01)
(Continued)

(52) U.S. Cl.
CPC ..... *H01H 33/7038* (2013.01); *H01H 33/121* (2013.01); *H01H 33/22* (2013.01);
(Continued)

(58) Field of Classification Search
CPC ..... H01H 33/121; H01H 33/22; H01H 33/56; H01H 33/7023; H01H 33/7038;
(Continued)

(56) References Cited

U.S. PATENT DOCUMENTS 4,276,456 A * 6/1981 Cromer ..... H01H 33/91 218/59
4,471,187 A * 9/1984 Sturzenegger ..... H01H 33/91 218/117
(Continued)

FOREIGN PATENT DOCUMENTS

EP 2445068 A1 4/2012
GB 2034121 A 5/1980
(Continued)

OTHER PUBLICATIONS

European Extended Search Report Application No. 17178561.1 Completed: Dec. 19, 2017 dated Jan. 15, 2018 9 Pages.
(Continued)

*Primary Examiner* — William A Bolton
(74) *Attorney, Agent, or Firm* — Whitmyer IP Group LLC

(57) ABSTRACT

A load-break switch has a housing holding insulation gas at ambient pressure; a first main contact and a second main contact being movable relative to each other in an axial direction of the switch; a first arcing contact and a second arcing contact being movable relative to each other in the axial direction and defining an arcing region where an arc is formed during a current breaking operation, wherein the arcing region is located radially inward from the first main contact; a pressurizing system pressurizing a quenching gas during the current breaking operation; and a nozzle system arranged to blow the pressurized quenching gas onto the arc. The first main contact includes at least one pressure release opening to allow gas flow in a radial outward direction. A
(Continued)

total area of the pressure release opening suppresses a reduction of gas flow out of the pressure release opening.

15 Claims, 3 Drawing Sheets

(51) Int. Cl.
*H01H 33/56* (2006.01)
*H01H 33/70* (2006.01)
*H01H 33/91* (2006.01)

(52) U.S. Cl.
CPC ..... *H01H 33/56* (2013.01); *H01H 33/91* (2013.01); *H01H 2033/566* (2013.01)

(58) Field of Classification Search
CPC ..... H01H 33/91; H01H 2033/906; H01H 2033/908; H01H 2033/566
USPC .... 218/9, 13, 14, 16, 17, 51–55, 57, 59, 61, 218/63, 60, 68, 66, 93, 97, 116
See application file for complete search history.

(56) References Cited

U.S. PATENT DOCUMENTS 4,663,504 A * 5/1987 Barkan ..... H01H 33/02 200/302.3
6,646,850 B1 * 11/2003 Bergmann ..... H01H 33/7015 218/53
6,660,954 B2 * 12/2003 Iwabuchi ..... H01H 33/91 218/51
8,389,886 B2 * 3/2013 Dahlquist ..... H01H 33/74 218/45
8,674,253 B2 * 3/2014 Uchii ..... H01H 33/905 218/59
8,779,316 B2 * 7/2014 Drews ..... H01H 33/74 218/51
2005/0150868 A1 * 7/2005 Nowakowski ..... H01H 33/91 218/57
2007/0221626 A1 9/2007 Uchii
2013/0126481 A1 * 5/2013 Ozil ..... H01H 33/901 218/157
2014/0251957 A1 * 9/2014 Cernat ..... H01H 33/58 218/51
2016/0307716 A1 * 10/2016 Florez ..... H01H 33/22

FOREIGN PATENT DOCUMENTS

JP 2000067716 A 3/2000
WO 2014094891 A1 6/2014

OTHER PUBLICATIONS

International Search Report and Written Opinion of the International Searching Authority Application No. PCT/EP2018/065480 Completed: Jul. 25, 2018; dated Aug. 13, 2018 17 Pages.

* cited by examiner

GAS-INSULATED LOAD BREAK SWITCH AND SWITCHGEAR COMPRISING A GAS-INSULATED LOAD BREAK SWITCH

TECHNICAL FIELD

The disclosure relates to a gas-insulated load break switch with an arc-extinguishing capability, and to a switchgear such as an electric power distribution switchgear comprising such a gas-insulated load break switch.

BACKGROUND

Load break switches constitute an integral part of units assigned to the task of switching load currents, with typical load currents being in a range of 400 A to 2000 A root mean square. The switch is opened or closed by a relative movement of contacts, e.g. a plug contact and a tulip-type contact. When the contacts are moved away from each other during a current-breaking operation, an electric arc may be formed between the separating contacts.

In load break switches which have a mechanism with an arc-extinguishing capability, such as puffer mechanism, a quenching gas is compressed in a puffer volume and released into an arcing region or arc quenching region. During an opening operation, a piston through a displacement stroke, the quenching gas is compressed, and an overpressure occurs in the compression chamber. At the same time, the tulip contact is pulled away from the plug contact, and the electric arc is generated. During the interruption, the arc heats up the gas volume around the contacts. Hot insulation gas has a lower insulation capability than the same insulation gas at a lower temperature. The hot gas increases a risk of a dielectric re-strike, even if the arc was successfully interrupted beforehand (i.e., even if a preceding thermal interruption was successful).

In typical applications, sulfur hexafluoride (SF) is used as a quenching gas or insulating gas. $SF_6$ has excellent dielectric properties for the purpose of insulation, as well as excellent arc cooling or arc quenching properties and thermal dissipating properties. Therefore, the use of $SF_6$ allows for compact load break switches and compact switchgears having such $SF_6$-based load break switches. However, the global warming potential of $SF_6$ has led to developing gas-insulated load break switches and/or switchgear with alternative insulation gases.

Document EP 2 445 068 A1 describes a gas circuit breaker comprising an insulation gas of $CO_2$ gas or a gas including $CO_2$ gas as the main component. The gas circuit breaker includes a high-voltage unit, a zeolite and the insulation gas in a closed vessel.

Document WO 2014/094891 A1 describes an electrical switching device having arcing contacts and main contacts. A first arcing contact is attached to an exhaust tube, the exhaust tube being surrounded by an exhaust volume. Another exhaust volume follows a second arcing contact.

SUMMARY

An object of the disclosure is to provide an improved gas-insulated load break switch which allows for a reliable arc extinction even under difficult conditions, while still maintaining a compact or low-cost design. Another object of the disclosure is to provide an improved switchgear having a gas-insulated load break switch as described herein, wherein a reliable arc-extinguishing operation of the load break switch does not substantially affect an interphase behavior between neighboring phases.

In view of the above, a gas-insulated load break switch and a switchgear according to the claims, are provided.

According to a first aspect, the gas-insulated load break switch, such as a low- or medium-voltage gas-insulated load break switch, comprises a housing, a first main contact and a second main contact, a first arcing contact and a second arcing contact, a pressurizing system, and a nozzle system. The housing defines a housing volume for holding an insulation gas at an ambient pressure. The first main contact and the second main contact are movable in relation to each other in an axial direction of the load break switch. The first arcing contact and the second arcing contact are movable in relation to each other in an axial direction of the load break switch and define an arcing region. In the arcing region, an arc is formed during a current breaking operation. The arcing region is located at least partially radially inward from the first main contact. The pressurizing system has a pressurizing chamber for pressurizing a quenching gas during the current breaking operation. The nozzle system is arranged and configured such as to blow the pressurized quenching gas onto the arc which is formed in the quenching region during the current breaking operation. The nozzle system has a nozzle supply channel for supplying at least one nozzle with the pressurized quenching gas.

In the first aspect, the first main contact comprises at least one pressure release opening. The pressure release opening is formed such as to allow a flow of gas substantially in a radial outward direction. The flow of gas during an arc extinguishing operation is typically a flow of pressurized gas which has been released by the nozzle system into the quenching region, or arc extinguishing region.

In the first aspect, further, the total area of the at least one pressure release opening is configured such that during a supply of the pressurized quenching gas, a reduction of the flow of gas out of the pressure release opening is suppressed. Thus, the area of the at least one pressure release opening is designed such as to be large enough not to cause a substantial gas flow reduction of the quenching gas.

A flow reduction may for example relate to a reduction of a flow speed of the gas flowing out of the pressure release opening. Additionally or alternatively, a flow reduction may for example relate to a reduction of a flow rate or a flow volume of the gas flowing out of the pressure release opening. A substantial gas flow reduction, as used herein, is assumed when the discharge process of the pressurized quenching gas through a respective opening, such as the pressure release opening, is insufficient to an extent that a dielectric re-strike or re-ignition is likely to occur due to the gas, which is heated by the arc, flowing towards the main contact.

As used herein, in the case that only one single opening such as the pressure release opening is provided, a total area refers to the area of single opening which can be used by the pressurized quenching gas to flow out through this opening. Consequently, in the case that more than one respective opening is provided, such as a succession of pressure release openings in the main contact which are separated from each other by solid material, a total area refers to the cumulative effective area of all openings which are involved in the respective gas flow.

By designing the at least one pressure release opening such that the gas flow of the pressurized quenching gas is substantially not reduced from the quenching region to the other side of the openings, an accumulation of hot gas around the main contact can be reduced during a current-breaking operation. The hot gas can be effectively flow away from the quenching region, in a relatively unhindered manner. A volume of colder gas replaces the hot gas. The colder gas has a higher insulation level. Thereby, a dielectric re-strike after a thermal arc interruption may be prevented.

In embodiments, the nozzle supply channel has, at least in a connection region with the pressurizing chamber, a substantially uniform cross-section. In the connection region, the nozzle supply channel opens out into the pressurizing chamber (i.e., empties into the pressurizing chamber), and the cross-section in this region contributes to the behavior of the gas inside the pressurizing chamber. In case of a plurality of nozzle supply channels, the cross-section of the nozzle supply channel is defined as an effective cross-section of the plurality of nozzle supply channels.

In embodiments, the total area of the at least one pressure release opening is more than 4 (four) times the cross-section of the nozzle supply channel. A total area of more than four times the cross-section of the nozzle supply channel may help to ensure an effective gas flow away from the quenching region, and prevent an accumulation of hot gas in or around the quenching region to prevent a dielectric re-strike.

In embodiments, the total area of the at least one pressure release opening is less than 5 (five) times the cross-section of the nozzle supply channel. Typically, the total area of the at least one pressure release opening is more than four times and less than five times the cross-section of the nozzle supply. Limiting the opening to less than five times the cross-section of the nozzle supply channel may help to ensure a sufficient current-carrying capability of the first main contact, while limiting the opening to more than four times the cross-section of the nozzle supply channel may help to ensure an effective gas flow away from the quenching region, and prevent an accumulation of hot gas in or around the quenching region to prevent a dielectric re-strike.

In embodiments, the gas-insulated load break switch further comprises an interruption chamber. The first main contact is arranged, at least partially, within the interruption chamber (inside the interruption chamber). The interruption chamber typically has, at least in a region where the first main contact is arranged, a substantially uniform cross-section.

The interruption chamber comprises at least one gas outlet opening. The total area of the gas outlet opening is at least the total area of the at least one pressure release opening of the main contact. Additionally or alternatively, the total area of the gas outlet opening is more than ⅓ (a third) of the area of the substantially uniform cross-section of the interruption chamber. In further embodiments, the total area of the gas outlet opening is more than ⅓ (a third) and less than ½ (a half) of the area of the substantially uniform cross-section of the interruption chamber. As above, a total area, as used herein, refers to the cumulative effective area of all openings which are involved in a respective gas flow.

In embodiments, the at least one gas outlet opening is formed such as to allow, in co-operation with the at least one pressure release opening, a flow of gas substantially in a radial outward direction into an ambient-pressure region of the housing volume.

Designing the gas outlet opening in this way may help to ensure that the hot gas from the arcing region or quenching region can be released effectively not only through the main contact, but also out of the interruption chamber into the housing volume. Thus, an accumulation of hot gas in or around the quenching region may be reduced or prevented, and a dielectric re-strike may be prevented from occurring.

In embodiments, the gas-insulated load break switch further comprises a gas flow directing member. The gas flow directing member is configured and arranged such that the flow of gas is directed to a region having a low electrical field. Optionally, the gas flow directing member is configured and arranged such that the flow of gas is directed away from an external contacting terminal of the gas-insulated load break switch. The electrical field in the low electrical field region is typically significantly lower than an electrical field in the vicinity of the external contacting terminal of the gas-insulated load break switch, for example half as low or less.

The gas flow directing member may be essentially cup-shaped, and/or it may have a rounded surface.

When the hot gas is not only directed away from the arcing region or quenching region, but also away from a region which is known to have a high electrical field strength, a dielectric re-strike may be even more reliably prevented from occurring.

In embodiments, the first arcing contact has, at least in a contacting region with the second arcing contact, a substantially uniform cross-section, and the first arcing contact comprises at least one gap extending in the axial direction. The gap is designed such that it allows a flow of gas, typically a flow of pressurized quenching gas, to flow through it. Typically, the gap has at least ¼ (a fourth) of the area of the substantially uniform cross-section of the first arcing contact.

The first arcing contact may thus be split, with a width of the split allowing for a sufficient gas flow. In the exemplary case of a first arcing contact having a round cross-section, a width which is sufficient may correspond to at least ¼ of the arc pin diameter. The local temperature distribution during an arc quenching operation may be further improved by this measure.

In embodiments, the pressurizing system is a puffer system, and the pressurizing chamber is a puffer chamber with a piston arranged for compressing the quenching gas on a compression side of the puffer chamber during the current breaking operation. A puffer type switch can manage a relatively high electric power while the dielectric requirements of the medium which surrounds the load break switch are comparatively low.

In this embodiment, the piston of the puffer system comprises at least one auxiliary opening which connects the compression side with an opposite side of the piston. A total cross-section area of the at least one auxiliary opening is designed for allowing a sufficient flow of gas through it. Typically, the total cross-section area of the at least one auxiliary opening is at least ⅓ (a third) of the area of a total gas outflow cross-section of the nozzle system.

A total gas outflow cross-section is the effective cross-section which contributes to a flow of pressurized quenching gas out of the nozzle system into the direction of the quenching region. The gas which flows from the compression chamber through the auxiliary hole(s) in the piston may cover the moving main contact with relatively cold gas. The higher insulation capabilities of the colder gas may help to prevent dielectric re-strikes in the region of the moving main contact.

In embodiments, the second arcing contact comprises a hollow section. The hollow section extends substantially in the axial direction and is arranged such that a gas portion from the quenching region flows from the quenching region into the hollow section.

In embodiments, the hollow section has an outlet for allowing the gas portion which has flown into the hollow section to flow out at an exit side of the hollow section into an ambient-pressure region of the housing volume. The exit side may be at a significant distance from an entry portion of the hollow cross-section in which the gas portion enters the hollow section.

The hollow section may contribute in a flow of hot gas away from the quenching region, such that dielectric re-strikes are even more reliably prevented.

In embodiments, the nozzle comprises an insulating outer nozzle portion. Additionally or alternatively, the nozzle is arranged, at least partially, on a tip end of the second arcing contact. Optionally, the insulating outer nozzle portion, if present, is arranged on the tip end of the second arcing contact.

In embodiments, the insulation gas has a global warming potential lower than the one of $SF_6$ over an interval of 100 years, and wherein the insulation gas preferably comprises at least one gas component selected from the group consisting of: $CO_2$, $O_2$, $N_2$, $H_2$, air. $N_2O$, a hydrocarbon, in particular $CH_4$, a perfluorinated or partially hydrogenated organofluorine compound, and mixtures thereof. In further embodiments, the insulation gas comprises a background gas, in particular selected from the group consisting $CO_2$, $O_2$, $N_2$, $H_2$, air, in a mixture with an organofluorine compound selected from the group consisting of: fluoroether, oxirane, fluoroamine, fluoroketone, fluoroolefin, fluoronitrile, and mixtures and/or decomposition products thereof. For example, the dielectric insulating medium may comprise dry air or technical air. The dielectric insulating medium may in particular comprise an organofluorine compound selected from the group consisting of: a fluoroether, an oxirane, a fluoroamine, a fluoroketone, a fluoroolefin, a fluoronitrile, and mixtures and/or decomposition products thereof. In particular, the insulation gas may comprise as a hydrocarbon at least $CH_4$, a perfluorinated and/or partially hydrogenated organofluorine compound, and mixtures thereof. The organofluorine compound is preferably selected from the group consisting of: a fluorocarbon, a fluoroether, a fluoroamine, a fluoronitrile, and a fluoroketone; and preferably is a fluoroketone and/or a fluoroether, more preferably a perfluoroketone and/or a hydrofluoroether, more preferably a perfluoroketone having from 4 to 12 carbon atoms and even more preferably a perfluoroketone having 4, 5 or 6 carbon atoms. The insulation gas preferably comprises the fluoroketone mixed with air or an air component such as $N_2$. $O_2$, and/or $CO_2$.

In specific cases, the fluoronitrile mentioned above is a perfluoronitrile, in particular a perfluoronitrile containing two carbon atoms, and/or three carbon atoms, and/or four carbon atoms. More particularly, the fluoronitrile can be a perfluoroalkylnitrile, specifically perfluoroacetonitrile, perfluoropropionitrile ($C_2F_5CN$) and/or perfluorobutyronitrile ($C_3F_7CN$). Most particularly, the fluoronitrile can be perfluoroisobutyronitrile (according to formula $(CF_3)_2CFCN$) and/or perfluoro-2-methoxypropanenitrile (according to formula $CF_3CF(OCF_3)CN$). Of these, perfluoroisobutyronitrile is particularly preferred due to its low toxicity.

In embodiments, the gas-insulated load break switch has a rated voltage of at most 52 kV, in particular 12 kV or 24 kV or 36 kV or 52 kV. The load break switch may be adapted for operating in a voltage range of 1 to 52 kV. The voltage range of 1 to 52 kV AC can be referred to as medium voltage as defined in the standard EC 62271-103. However, all voltages above 1 kV can be referred to as high voltage.

According to a further aspect of the disclosure, a gas-insulated switchgear is provided. The gas-insulated switchgear has a gas-insulated load break switch as described herein.

In embodiments, the gas-insulated switchgear comprises at least two gas-insulated load break switches, typically three gas-insulated load break switches or a multiple of three. Each load break switch comprises an external contacting terminal for respective different voltage phases. In a three-phase distribution system, each of the three gas-insulated load break switches of the switchgear serves to switch one of the three phases of the three-phase system.

In this embodiment, each load break switch further comprises a gas flow directing member, as already described herein. The gas flow directing member is configured and arranged to direct the flow of gas away from the external contacting terminals of the load break switches. Typically, the external contacting terminals are arranged in the direct vicinity of the respective gas flow directing member, optionally in close contact with the respective gas flow directing member.

In the region of the external contacting terminals, the electrical field strength is typically high, and blowing hot insulation gas with a comparatively low insulation property against this high field region may cause a dielectric re-strike. With the configuration as described above, a dielectric re-strike in a switchgear may effectively be prevented.

Alternatively or additionally, the gas flow directing member is configured and arranged to direct the flow of gas away from an interphase zone between neighboring voltage phases.

Hence, the flow pattern of the gas flow may be tailored in such a way that the hot gas, vapors etc. which are generated during an arcing event is transported away from a region with high electrical field stress, such as the interphase zone, and the highly stressed regions will not experience a reduced insulation level. Rather, the hot gas is directed away from the interphase zone and preferably to a region where the electrical stress is low.

Further advantages, features, aspects and details that can be combined with embodiments described herein and are disclosed in the dependent claims and claim combinations, in the description and in the drawings.

BRIEF DESCRIPTION OF THE DRAWINGS

The disclosure will now be described in greater detail with reference to the drawings in which.

DETAILED DESCRIPTION

Figure 1:
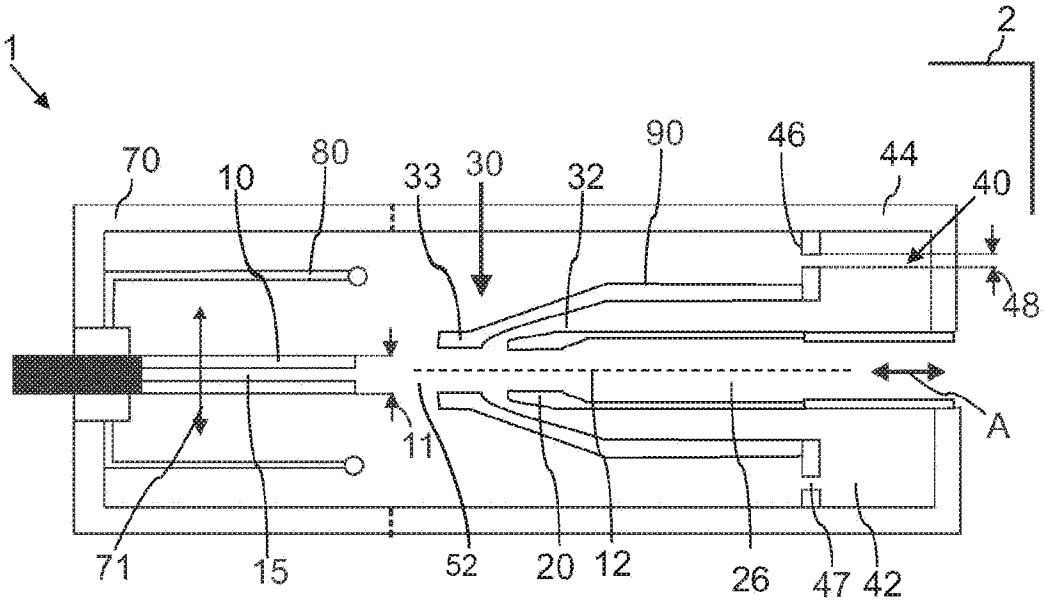
FIG. 1 shows a schematic cross-sectional view of a gas-insulated load break switch according to an embodiment.

Reference will now be made in detail to the various aspects and embodiments. Each aspect and embodiment are provided by way of explanation and is not meant as a limitation. For example, features illustrated or described as part of one aspect or embodiment can be used on or in conjunction with any other aspect or embodiment. It is intended that the present disclosure includes such combinations and modifications.

Within the following description of embodiments shown in the drawings, the same reference numbers refer to the same or to similar components. Generally, only the differences with respect to the individual embodiments are described. Unless specified otherwise, the description of a part or aspect in one embodiment applies to a corresponding part or aspect in another embodiment, as well.

FIG. 1 shows a schematic cross-sectional view of a gas-insulated load break switch 1 according to an embodiment. In FIG. 1, the switch is shown in an open state. The switch has a gas-tight housing 2 which is filled with an electrically insulating gas at an ambient pressure. The shown components are arranged within the housing volume 2 which is filled with the gas.

The switch 1 has a first arcing contact (e.g., a stationary pin contact) 10 and a second arcing contact (e.g., a movable tulip contact) 20. The fixed contact 10 is solid, while the movable contact 20 has a tube-like geometry with a tube portion 24 and an inner volume or hollow section 26. The movable contact 20 can be moved along the axis 12, in an axial direction A, away from the stationary contact 10 for opening the switch 1.

The switch 1 further has a first main contact 80 and a second main contact 90 designed to carry and conduct a nominal current during nominal operation. In an opening operation, the second main contact 90 is moved away from the (stationary) first main contact 80, and the current from the main contacts 80, 90 is taken over by the arcing contacts 10, 20.

The switch 1 further has a puffer-type pressurizing system 40 with a pressurizing chamber 42 having a quenching gas contained therein. The quenching gas is a portion of the insulation gas contained in the housing volume of the switch 1. The pressurizing chamber 42 is delimited by a chamber wall 44 and a piston 46 for compressing the quenching gas within the puffer chamber 42 during the current breaking operation.

The switch 1 further has a nozzle system 30. The nozzle system 30 comprises a nozzle 33 connected to the pressurizing chamber 42 by a nozzle channel 32. The nozzle 33 is arranged axially outside the tulip contact 20. In embodiments, several nozzles may be arranged at different azimuthal positions along a circle about the axis 12; and the term "nozzle" herein preferably refers to each of these nozzles.

During a switching operation, as shown in FIG. 1, the movable contact 20 is moved by a drive (not shown) along the axis 12 away from the stationary contact 10 (to the right in FIG. 1*b*) into the open position shown in FIG. 1. Thereby, the arcing contacts 10 and 20 are separated from one another, and an arc forms in an arcing region or quenching region 52 between both contacts 10 and 20.

The nozzle system 30 and the piston 46 are moved by a drive (not shown), during the switching operation, together with the tulip contact 20 away from the pin contact 10. The other chamber walls 44 of the pressurizing volume 42 are stationary. Thus, the pressurizing volume 42 is compressed and the quenching gas contained therein is brought to a quenching pressure which is defined as the maximum total pressure (overall, i.e. neglecting localized pressure build-up) within the pressurizing chamber 42.

The nozzle system 30 then blows the pressurized quenching gas from the pressurization chamber 42 onto the arc. For this purpose, the quenching gas from the pressurization chamber 42 is released and blown through the channel 32 and the nozzle 33 onto the arcing zone 52. Thus, the quenching gas flows towards the arcing zone 52. From the arcing zone 52, the gas flows in a predominantly axial direction away from the arcing zone.

Figure 2:
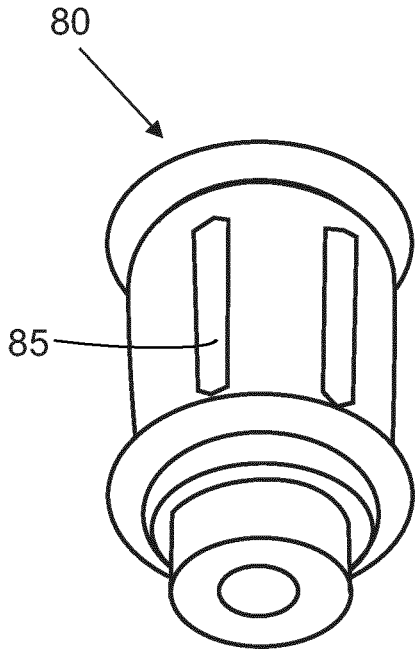
FIG. 2 shows a perspective view of a first main contact of the embodiment of FIG. 1.
Figure 3:
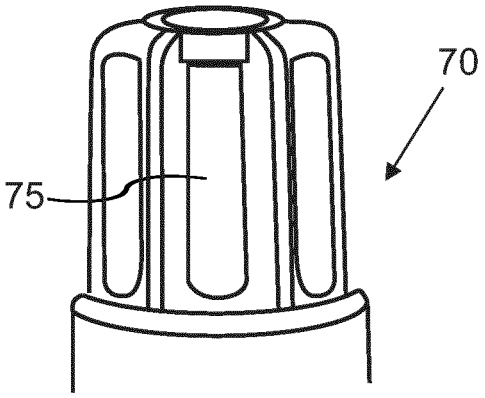
FIG. 3 shows a perspective view of an interruption chamber of the embodiment of FIG. 1.
Figure 4:
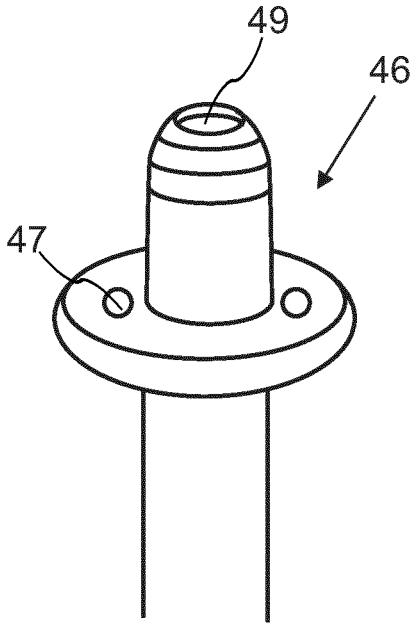
FIG. 4 shows a perspective view of a piston of the embodiment of FIG. 1.

Referring to FIGS. 2 to 4, elements of the switch of embodiment of FIG. 1 are shown in a perspective view. FIG. 2 shows a perspective view of the first main contact 80, FIG. 2 shows a perspective view of the interruption chamber 70, and FIG. 3 shows a perspective view of the piston 46.

Referring back to FIG. 1 in a synopsis with FIGS. 2 to 4, the first main contact 80 of the embodiment comprises pressure release openings 85, of which two are shown in FIG. 2. The pressure release openings 85 may be provided circumferentially in regular or irregular intervals; moreover, it is possible that only one pressure release opening 85 is provided in the first main contact. The entirety of all pressure release openings 85 may be referred to as "pressure release opening 85" herein.

The pressure release opening 85 of the embodiment shown in FIGS. 1-4 is formed in a circumferential wall of the first main contact 80 and extends in the axial direction A. Thus, the pressure release opening 85 allows a flow of pressurized quenching gas out of the arcing region 52 in a radial outward direction.

The pressure release opening 85 is configured such that a flow of the pressurized quenching gas, which extends by the heat of the arc in the arcing region 52, is substantially not reduced. In other words. The total area of the pressure release opening(s) 85 is large enough not to cause any gas flow reduction of the quenching gas, e. g. a reduction of the gas flow volume.

In the embodiment of FIGS. 1-4, the total area of the pressure release openings 85 is more than 4 times of the cross-section of the nozzle supply channel which supplies the nozzle 33 with the quenching gas, while at the same time being less than 5 times of the cross-section of the nozzle supply channel. In this way, a sufficient current conduction is ensured, and the insulation gas heated up by the arc, having reduced dielectric properties (lower insulation properties) than the same insulation gas in a colder state, is efficiently directed away from the arcing region in between the contacts, thereby helping to prevent any dielectric re-strike (re-ignition) of the arc from occurring.

In the embodiment of FIGS. 1-4, the switch 1 further comprises an interruption chamber, see FIG. 3. The first main contact 80 and the second main contact 90, as well as the first arcing contact 10 and the second arcing contact 20, are arranged inside the interruption chamber 70.

The interruption chamber 70 has gas outlet opening 75. The total area of the gas outlet openings 75 is at least the total area of the pressure release openings 85. Thereby, the hot insulation gas is directed out of the interruption chamber 70 into an ambient-pressure region of the housing volume 2. In the shown embodiment, the total area of the gas outlet openings 75 of the interruption chamber 70 is more than ⅓ of the area of a substantially uniform cross-section 71 of the interruption chamber 70, wherein the substantially uniform cross-section 71 is provided at least in a region where the first main contact 80 is arranged.

Optionally, the total area of the gas outlet openings 75 of the interruption chamber 70 is more than ⅓ and less than ½ of the area of the substantially uniform cross-section 71 of the interruption chamber 70.

In the embodiment of FIGS. 1-4, the piston 46, shown in more detail in FIG. 4, is provided with auxiliary openings 47, e. g. in a flange portion of the piston 46, which connect the compression side with an opposite side of the piston 46. In FIG. 4, a total cross-section area 48 of the at least one auxiliary opening 47 is at least ⅓ of the area of a total gas outflow cross-section of the nozzle system. A sufficient amount of cold insulation gas may flow to the moving main contact (the second main contact 90) and cover its contacting region. The cold gas has a higher insulation level and may therefore help to prevent re-strikes in this region.

In the piston 46 which holds the second main contact 90, a central opening 49 is provided which leads to a hollow section 26. The hollow section is arranged such that a portion of the quenching gas having been blown onto the arcing region 52 is allowed to flow from the arcing region 52 into the hollow section 26, and from there through an outlet of the hollow section 26 into the bulk housing volume 2 of the load break switch 1.

In embodiments, a double flow design may occur at the tip of the nozzle 33, wherein the insulation gas accelerates into different possible directions. The hot gas may therefore split into a portion which flows radially outward and is released into the housing volume through openings 75, 85, and into another portion which is released through the outlet of the hollow section 26 into the housing volume of the switch 1.

Some possible applications for the load break switch 1 are a low- or medium voltage load break switch and/or a switch-fuse combination switch; or a medium-voltage disconnector in a setting in which an arc cannot be excluded. The rated voltage for these application is at most 52 kV.

By applying the openings for the flow of hot gas, as described herein, to a low- or medium-voltage load break switch, its thermal interruption performance can significantly be improved. This permits, for example, the use with an insulation gas being different from $SF_6$. $SF_6$ has excellent dielectric and arc quenching properties, and has therefore conventionally been used in gas-insulated switchgear. However, due to its high global warming potential, there have been large efforts to reduce the emission and eventually stop the usage of such greenhouse gases, and thus to find alternative gases, by which $SF_6$ may be replaced.

Such alternative gases have already been proposed for other types of switches. For example, WO 2014/154292 A1 discloses an $SF_6$-free switch with an alternative insulation gas. Replacing $SF_6$ by such alternative gases is technologically challenging, as $SF_6$ has extremely good switching and insulation properties, due to its intrinsic capability to cool the arc.

The present configuration allows the use of such an alternative gas having a global warming potential lower than the one of $SF_6$ in a load break switch, even if the alternative gas does not fully match the interruption performance of $SF_6$.

In some embodiments, due to the openings that prevent an accumulation of the hot gas while still maintaining a sufficient current carrying capability, this improvement can be achieved without significantly increasing the machining for the involved parts.

Figure 5:
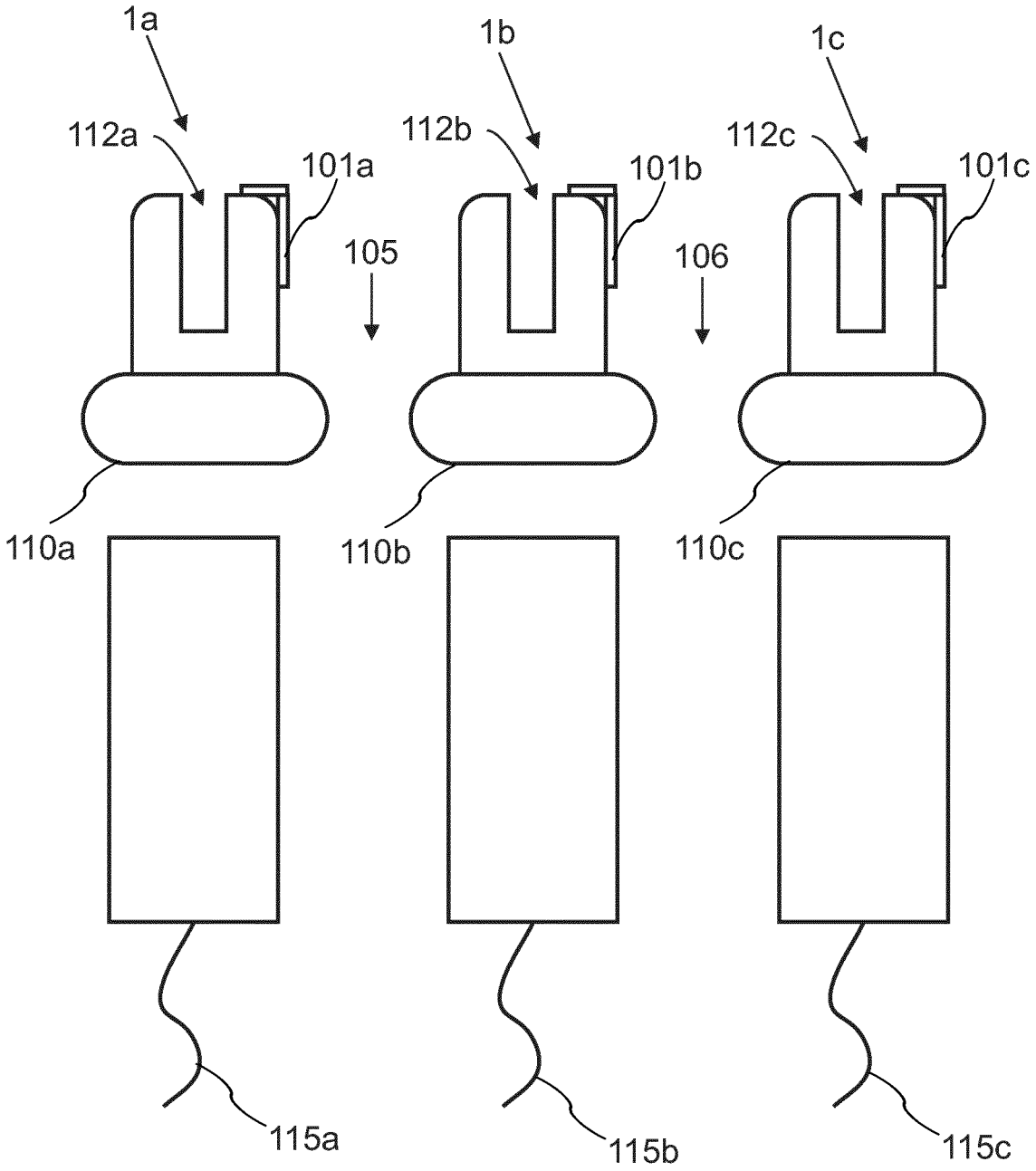
FIG. 5 shows a schematic cross-sectional view of a switchgear having three gas-insulated load-break switches, according to a further embodiment.

An application of the load break switch 1 is in a switchgear. A schematic sectional view of a switchgear 100 is shown in FIG. 5. In FIG. 5, by way of example, the switchgear 100 is a three-phase AC switchgear 100; as such, it comprises three load break switches 1*a*, 1*b*, 1*c*, each for switching one of the phases and each configured as a gas-insulated load break switch 1 as disclosed herein.

In the switchgear 100 of FIG. 5, parts of the switches 1*a*, 1*b*, 1*c* containing the movable contacts 20, 90 (not shown in FIG. 5) are each connected to a respective supply line 115*a*, 1, 115*b*, 115*c* for the respective phase. The movable contacts 20, 90 retract from the contact counterparts in the upper part of FIG. 5. A gas flow directing member 110*a*, 110*b*, 110*c* is provided at each of the switches 1*a*, 1*b*, 1*c* which houses the insulation chambers and the stationary contacts. External contacting terminals 101*a*, 101*b*, 101*c* are led out of the gas flow directing members 110*a*, 110*b*, 110*c* for establishing an external connection, from the stationary contacts, e.g. to a busbar (not shown).

The gas flow directing members 110*a*, 110*b*, 110*c* each have an opening 112*a*, 112*b*, 112*c* through which the flow of hot gas which occurs within the gas flow directing members 110*a*, 110*b*, 110*c* during an arcing event passes. The gas flow directing members 110*a*, 110*b*, 110*c* have their respective openings 112*a*, 112*b*, 112*c* direct away from the external contacting terminals 101*a*, 101*b*, 101*c*. Furthermore, the openings 112*a*, 112*b*, 112*c* also direct away from a zone in between the phase, i.e. an interphase zone 105 between the first phase and the second phase, and an interphase zone 106 between the second phase and the third phase.

As such, the hot gas is directed away from neighboring phases. In FIG. 5, the openings 112*a*, 112*b*, 112*c* allow the gas to flow out in the upward direction of FIG. 5, and laterally into a direction which is substantially perpendicular to a direction of alignment of the switches 1*a*, 1*b*, 1*c* (i.e., in FIG. 5, the gas flow is allowed in a direction perpendicular to the plane of projection).

Thus, the hot gas is directed away from an interphase zone 105, 106 which is a zone of high electrical field stress in the switchgear 100. Consequently, the interphase zone 105, 106 will not experience a reduced insulation level, as the hot gas is directed away from the interphase zone 105, 106, e.g. towards walls or roof of the switchgear 100 where the electrical stress is low.

The invention claimed is:

1. A gas-insulated load break switch, comprising:

a housing defining a housing volume for holding an insulation gas at an ambient pressure;

a first main contact and a second main contact, the first and second main contacts being movable in relation to each other in an axial direction of the load break switch;

a first arcing contact and a second arcing contact, the first and second arcing contacts being movable in relation to each other in the axial direction of the load break switch and defining an arcing region in which an arc is adapted to form during a current breaking operation, wherein the arcing region is located, at least partially, radially inward from the first main contact;

a pressurizing system having a pressurizing chamber for pressurizing a quenching gas during the current breaking operation;

a nozzle system arranged and configured to blow the quenching gas, which is pressurized, onto the arc formed in a quenching region during the current breaking operation, the nozzle system having a nozzle supply channel for supplying at least one nozzle with the pressurized quenching gas; and an interruption chamber, the first main contact being arranged, at least partially, within the interruption chamber;

wherein the first main contact includes at least one pressure release opening formed such as to allow a flow of gas substantially in a radial outward direction, wherein a total area of the at least one pressure release opening is configured such that during a supply of the pressurized quenching gas, a reduction of the flow of gas out of the pressure release opening is suppressed, wherein the total area of the at least one pressure release opening is less than 5 times of a cross-section of the nozzle supply channel, wherein the interruption chamber includes at least one gas outlet opening, a total area of the at least one gas outlet opening being at least the total area of the at least one pressure release opening and/or the total area of the at least one gas outlet opening being more than ⅓ of an area of a cross-section of the interruption chamber, wherein the at least one gas outlet opening is formed such as to allow, in co-operation with the at least one pressure release opening, the flow of gas substantially in the radial outward direction into an ambient-pressure region of the housing volume.

2. The gas-insulated load break switch of claim 1, further comprising a gas flow directing member configured and arranged to direct the flow of gas to a low electrical field region.

3. The gas-insulated load break switch of claim 2, wherein the gas flow directing member is configured and arranged to direct the flow of gas away from an external contacting terminal of the gas-insulated load break switch.

4. The gas-insulated load break switch of claim 1, wherein the first arcing contact has, at least in a contacting region with the second arcing contact, a substantially uniform cross-section, wherein the first arcing contact includes at least one gap extending in the axial direction of the load break switch, the gap having at least ¼ of an area of the substantially uniform cross-section of the first arcing contact.

5. The gas-insulated load break switch of claim 1, wherein the pressurizing system is a puffer system and the pressurizing chamber is a puffer chamber with a piston arranged for compressing the quenching gas on a compression side of the puffer chamber during the current breaking operation, wherein the piston includes at least one auxiliary opening connecting the compression side with an opposite side of the piston, wherein a total cross-section area of the at least one auxiliary opening is at least ⅓ of the area of a total gas outflow cross-section of the nozzle system.

6. The gas-insulated load break switch of claim 1, wherein the second arcing contact includes a hollow section extending substantially in the axial direction, the hollow section being arranged such that a gas portion from the quenching region flows from the quenching region into the hollow section.

7. The gas-insulated load break switch of claim 6, wherein the hollow section has an outlet for allowing the gas portion having flown into the hollow section to flow out at an exit side of the hollow section into an ambient-pressure region of the housing volume.

8. The gas-insulated load break switch of claim 1, wherein the nozzle includes an insulating outer nozzle portion; and/or wherein the nozzle is arranged, at least partially, at a tip end of the second arcing contact.

9. The gas-insulated load break switch of claim 8, wherein an insulating outer nozzle portion of the nozzle is arranged at the tip end of the second arcing contact.

10. The gas-insulated load break switch of claim 1, wherein the insulation gas has a global warming potential lower than the one of $SF_6$ over an interval of 100 years, and wherein the insulation gas includes at least one gas component selected from the group consisting of: $CO_2$, $O_2$, $N_2$, $H_2$, air, $N_2O$, a hydrocarbon, $CH_4$, a perfluorinated or hydrogenated organofluorine compound, and mixtures thereof.

11. The gas-insulated load break switch of claim 1, wherein the insulation gas includes a background gas, the background gas being selected from the group consisting of: $CO_2$, $O_2$, $N_2$, $H_2$, air, in a mixture with an organofluorine compound selected from the group consisting of: fluoroether, oxirane, fluoramine, fluoroketone, fluoroolefin, fluoronitrile, and mixtures and/or decomposition products thereof.

12. The gas-insulated load break switch of claim 1, having a rated voltage of at most 52 kV.

13. The gas-insulated load break switch of claim 1, wherein the total area of the at least one gas outlet opening is more than ⅓ and less than ½ of the area of the cross-section of the interruption chamber.

14. A gas-insulated switchgear, comprising:

at least one gas-insulated load break switch, each having:

a housing defining a housing volume for holding an insulation gas at an ambient pressure;

a first main contact and a second main contact, the first and second main contacts being movable in relation to each other in an axial direction of the load break switch;

a first arcing contact and a second arcing contact, the first and second arcing contacts being movable in relation to each other in the axial direction of the load break switch and defining an arcing region in which an arc is adapted to form during a current breaking operation, wherein the arcing region is located, at least partially, radially inward from the first main contact;

a pressurizing system having a pressurizing chamber for pressurizing a quenching gas during the current breaking operation;

a nozzle system arranged and configured to blow the quenching gas, which is pressurized, onto the arc formed in quenching region during the current breaking operation, the nozzle system having a nozzle supply channel for supplying at least one nozzle with the pressurized quenching gas;

an interruption chamber, the first main contact being arranged, at least partially, within the interruption chamber;

wherein the first main contact includes at least one pressure release opening formed such as to allow a flow of gas substantially in a radial outward direction, wherein a total area of the at least one pressure release opening is configured such that during a supply of the pressurized quenching gas, a reduction of the flow of gas out of the pressure release opening is suppressed, wherein the total area of the at least one pressure release opening is less than 5 times of a cross-section of the nozzle supply channel, wherein the interruption chamber includes at least one gas outlet opening, a total area of the at least one gas outlet opening being at least the total area of the at least one pressure release opening and/or the total area of the at least one gas outlet opening being more than ⅓ of an area of a cross-section of the interruption chamber, wherein the at least one gas outlet opening is formed such as to allow, in co-operation with the at least one pressure release opening, the flow of gas substantially in the radial outward direction into an ambient-pressure region of the housing volume.

15. The gas-insulated switchgear of claim 14, wherein the at least one gas-insulated load break switch comprises at least two gas-insulated load break switches, wherein each load break switch includes an external contacting terminal for respective different voltage phases, and wherein each load break switch further includes a gas flow directing member, wherein the gas flow directing member is configured and arranged to direct the flow of gas away from the external contacting terminal and/or wherein the gas flow directing member is configured and arranged to direct the flow of gas away from an interphase zone between neighboring voltage phases.

* * * * *